United States Patent [19]

Boundy et al.

[11] Patent Number: 4,874,027

[45] Date of Patent: Oct. 17, 1989

[54] OFFICE SPACE DIVIDING ARRANGEMENT

[75] Inventors: Bruce K. Boundy, Alto, Mich.; Raoul J. P. Schoumaker, Greenbay, Wis.

[73] Assignee: Westinghouse Electric Corp., Pittsburgh, Pa.

[21] Appl. No.: 197,018

[22] Filed: May 20, 1988

[51] Int. Cl.[4] ..... F06B 9/24; A47B 5/00

[52] U.S. Cl. ..... 160/230; 52/36; 52/239; 160/135; 160/218

[58] Field of Search ..... 160/135, 218, 220, 229.1, 160/230, 231.1, 231.2, 232; 211/194; 52/36, 239

[56] References Cited

U.S. PATENT DOCUMENTS

| | | | |
|---|---|---|---|
| 874,046 | 12/1907 | Whiting | 160/230 |
| 1,697,277 | 1/1929 | Hoopes | 160/231.1 |
| 2,771,334 | 11/1956 | Wahlbom | 160/135 |
| 2,930,665 | 3/1960 | Budai | 52/730 |
| 3,463,218 | 8/1969 | Cannon et al. | 160/135 |
| 3,592,289 | 7/1971 | Aysta | 160/231.2 |
| 3,786,765 | 1/1974 | Burr | 312/111 |
| 3,871,435 | 3/1975 | Lopathos | 160/229.1 |
| 3,913,598 | 10/1975 | Glutting, Jr. et al. | 160/229.1 |
| 3,913,656 | 10/1975 | Guyer | 160/135 |
| 3,916,972 | 11/1975 | Breiner | 160/135 |
| 4,030,219 | 6/1977 | Donovan | 160/135 |
| 4,144,924 | 3/1979 | Vanden Hoek | 160/231.2 |
| 4,166,332 | 9/1979 | Donovan | 160/135 |
| 4,531,564 | 7/1985 | Hanna | 160/229.1 |
| 4,610,560 | 9/1986 | Miller | 160/229.1 |
| 4,631,881 | 12/1986 | Charman | 160/135 |
| 4,722,146 | 2/1988 | Kemeny | 160/135 |

FOREIGN PATENT DOCUMENTS

| | | | |
|---|---|---|---|
| 1267807 | 5/1968 | Fed. Rep. of Germany | 160/229.1 |

*Primary Examiner*—Michael Safavi
*Attorney, Agent, or Firm*—D. R. Lackey

[57] ABSTRACT

An open office space dividing arrangement in which both simple and complex work station configurations are constructed from a small number of different free-standing units which share no walls with adjacent work stations. The units may be individually moved without dismantling, and without disturbing adjacent units or work stations to reconfigure a complex work station at the present location of the units, or the units may be moved as a whole to a different location and placed in the same or in a diferent work station configuration. Each unit is constructed according to the same concept in which a plurality of modules are vertically stacked to a desired height, with each module having two or three integrally joined sections which form diferent walls of the unit. The modules are foldable along one or two bend lines which separate and define the lateral sections, between shipping and functional configurations.

33 Claims, 10 Drawing Sheets

OFFICE SPACE DIVIDING ARRANGEMENT

TECHNICAL FIELD

The invention relates in general to an office space dividing arrangement, and more specifically to an office space dividing arrangement which facilitates shipping and assembly of multiple work station configurations, and which also facilitates subsequent change and/or relocation of work station configurations.

BACKGROUND ART

Open office furniture systems are quite flexible, compared with drywall construction, with virtually all panel based office furniture systems of the prior art being capable of being erected, dismantled, and re-erected in a matter of a few hours. This is routinely done when the job description, or physical size, of a whole department changes. U.S. Pat. No. 3,762,116, which is assigned to the same assignee as the present application, is typical of such prior art panel based open office furniture systems.

When an employee's job description changes, or when an employee is assigned to a different department, the contents of the employee's work station are moved, while the work station itself remains unchanged. Packing and unpacking of the employee's belongings are time consuming, but necessary with most present office furniture systems.

Prior art specialized sub-type of systems furniture which may be erected, dismantled, and re-erected in modules, thus eliminating the necessity of packing up an employee's belongings for moving, share vertical wall divider surfaces between adjacent work stations. Thus, moving a module not only affects the person being moved, but also the person sharing the opposite wall.

It would be desirable, and it is an object of the present invention, to retain all of the advantages of prior art panel based open office furniture systems relative to flexibility, including ease in erecting, dismantling and re-erecting, while also eliminating the need in most cases to dismantle and re-erect work stations when they are moved. It would also be desirable, and it is another object of the invention, to eliminate the need to pack and unpack a person's belongings when the person's work location changes, without disturbing adjacent work stations and associated personnel.

DISCLOSURE OF THE INVENTION

The present invention diverges from commonly accepted prior art concepts relative to open office furniture systems, in which walls of adjacent work stations are shared. The present invention includes a relatively small number of different free-standing configurations or units which may in and of themselves function as a simple work station, and which may be combined end-to-end, side-by-side, back-to-back, facing the same or opposite directions, and combinations thereof, to create one or more complex work stations. Each of the free-standing units is movable as a whole without disturbing adjacent work stations, and without the necessity of unloading an employee's belongings. The units may be easily moved as a whole to another location and placed in the same complex work station configuration, or a different work station configuration, as desired.

Each free-standing unit is originally assembled from a plurality of discrete, vertically stackable modules to the height of a desired or required privacy screen, with each module being two or three sections wide. Each module includes two or three integrally connected lateral sections defined or separated by vertically oriented bend lines or bends which function as joints to enable each section to form part of a different wall of the unit. Each module is constructed such that it is foldable along the bend line, or bend lines, between shipping and functional configurations. The shipping configuration folds the sections of a module to minify the space or volume occupied by the module during shipment from a factory to an office site, while the functional configuration is achieved by simply unfolding the sections of the module to provide the angles between them required by the unit configuration.

In a preferred embodiment of the invention, the functional angles between sections of a module of all units are selected to cause the associated sections to either lie either upon the rows or columns of an imaginary grid constructed of squares having a dimension of N per side, or upon a diagonal thereof. Thus, all section widths of a module are either equal to an integer of N, e.g., N, 2N, 3N, etc., or the square root of $2N^2$, which simplifies dimensioning, as well as facilitating effective use of available office floor space.

Accessories, such as work surfaces, file cabinets, shelves, and the like, are easily supported via brackets fixed to the accessories which engage grooves in the top or upper edge of each module, at any level of a unit.

BRIEF DESCRIPTION OF THE DRAWINGS

The invention will become more apparent by reading the following detailed description in conjunction with the drawings, which are shown by way of example only, wherein:

FIG. 17 is a plan view of the first basic unit configuration disposed on an imaginary grid having a dimension of N between the grid crossing points;

FIG. 18 is a variation of the first basic unit configuration, having a width dimension across the back of the unit equal to N, instead of 2N as in the FIG. 17 embodiment;

FIG. 19 is a plan view of the second basic unit configuration;

FIG. 20 is a plan view of the third basic unit configuration;

FIG. 23 is an exemplary layout of a plurality of work stations, placing units end-to-end and back-to-back.

DESCRIPTION OF PREFERRED EMBODIMENTS

Figure 1:
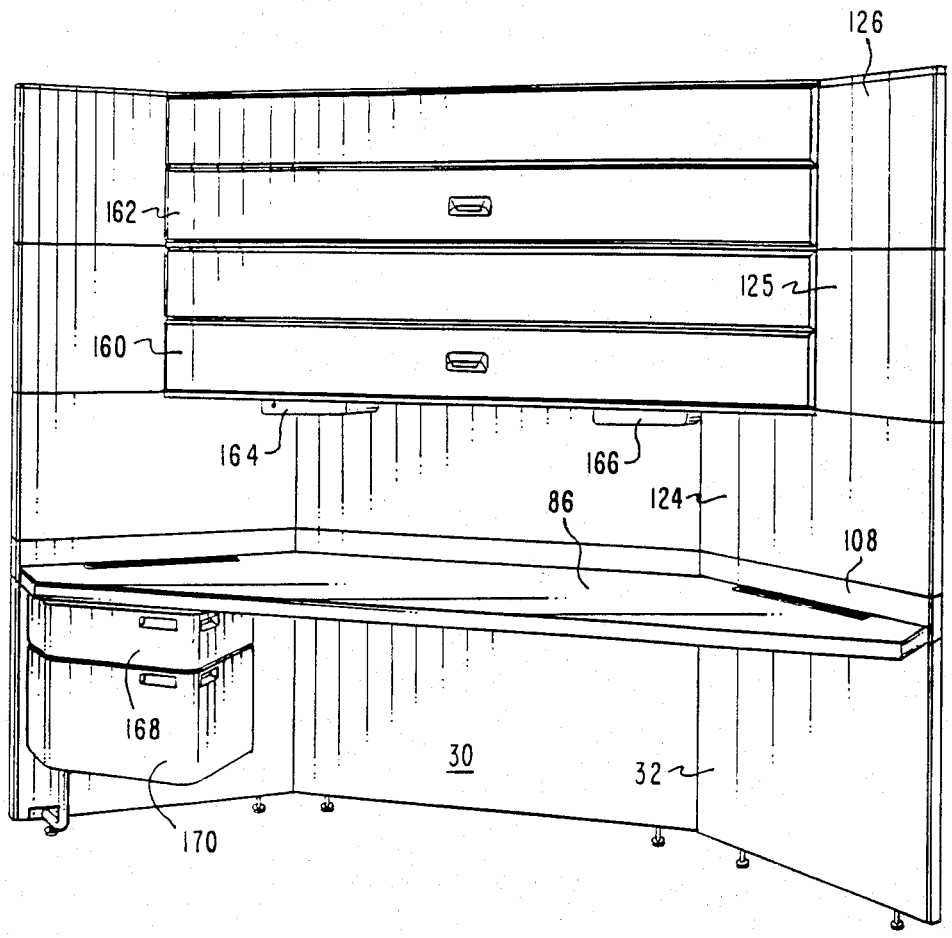
FIG. 1 is a perspective view of a first basic stand-alone unit constructed according to the teachings of the invention, which may function as a simple work station, or as part of a more complex work station.
Figure 2:
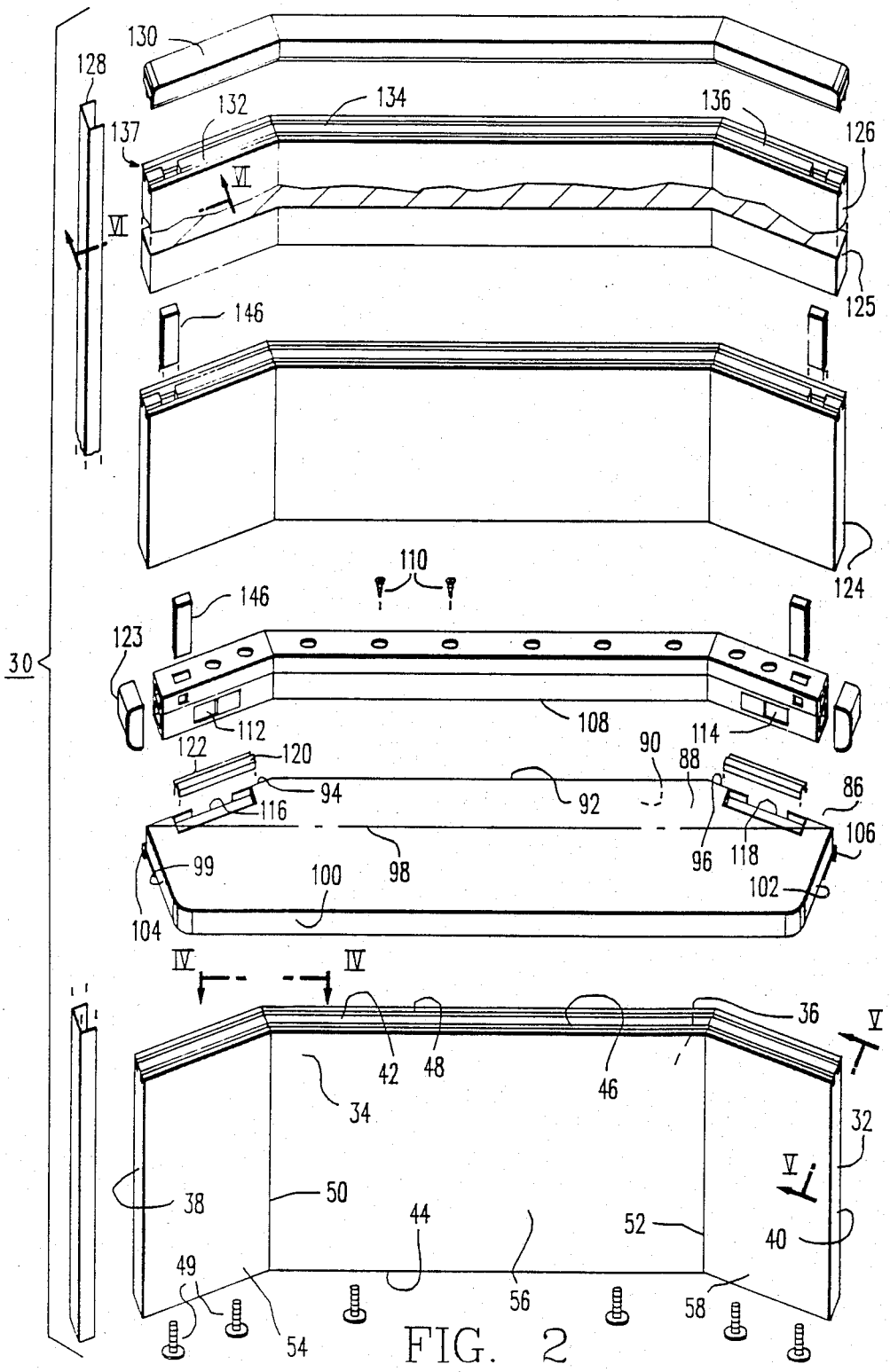
FIG. 2 is an exploded perspective view of the unit shown in FIG. 1, illustrating vertically stackable modules of the unit without the drawers and cabinet shown in FIG. 1.

Referring now to the drawings, and to FIGS. 1 and 2 in particular there is shown a first stand-alone unit 30 constructed according to the teachings of the invention, with FIG. 1 being a perspective view of unit 30 and FIG. 2 being an exploded perspective view without certain of the accessories shown in FIG. 1.

According to a concept of the invention, the first basic stand-alone unit 30, as well as other stand-alone units to be hereinafter described, all have a plurality of vertically stacked modules which create two or three upstanding, side-by-side, wall portions which function as a privacy screen. Each module has two or three integrally connected laterally disposed sections, with each module having a section disposed in each of the upstanding wall portions. Accessories, such as work surfaces, cabinets, shelves, and the like, are supported by grooves in the upper edges of a module at any, several, or all levels of a unit.

Referring to FIG. 2 with the above mentioned concept in mind, unit 30 includes a first module 32 which functions as a base module. Module 32 includes first and second sides or major surfaces 34 and 36, first and second ends 38 and 40, and upper and lower edges 42 and 44 which extend between the first and second ends 38 and 40. The uppermost edge 42 has first and second spaced grooves 46 and 48 which extend between ends 38 and 40 for supporting accessories, as will be hereinafter explained. The lower edge 44 has openings therein for receiving a plurality of levelers 49.

Module 32 has first and second spaced joints 50 and 52 which define vertically extending bend lines which separate module 32 into first, second and third sections 54, 56 and 58, respectively. In a preferred embodiment of the invention, joints 50 and 52 are formed when module 32 is manufactured, and sections 54, 56 and 58 are thereafter integrally joined or connected, i.e., joints 50 and 52 permanently interconnect the sections.

Figure 3A:
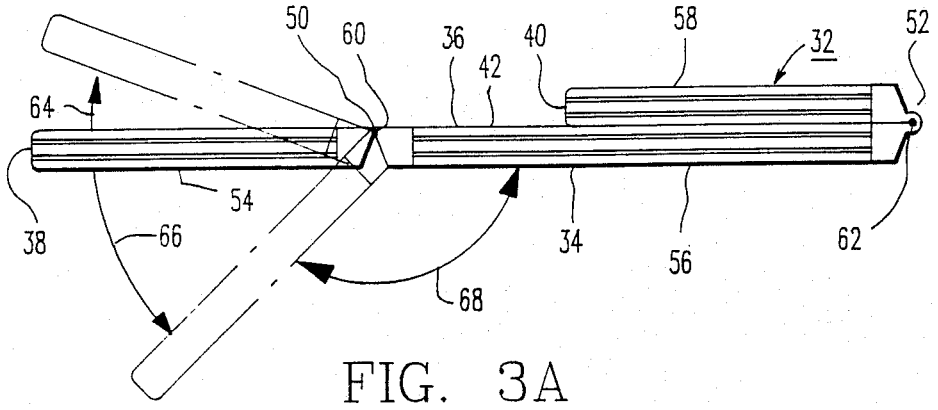
FIG. 3A is a plan view of one of the modules shown in FIG. 2, showing folding of the sections between shipping and functional positions according to a first embodiment of the invention.

Joints 50 and 52 are constructed such that the first module 32 is foldable along bend lines or axes defined by the joints, between shipping and functional configurations. FIG. 3A is a plan view of the upper edge 42 of module 32, with joints 50 and 52 constructed according to a preferred embodiment of the invention in which they allow about 225 degrees of movement about bend lines or axes 60 and 62 located closely adjacent to the second side 36 of module 32. The second sides 36 of the sections 54, 56 and 58 face one another when folded to minify shipping space or volume, in a shipping configuration in which at least one section is folded as illustrated re section 58. Section 54 may be folded in the direction of arrow 64 until it touches section 58, or it may be shipped in the same plane as section 56, as desired.

When module 32 arrives at an office site, sections 54 and 58 are unfolded to their functional positions. As illustrated in FIG. 3A, section 54 is folded in the direction of arrow 66 to a position shown in phantom, establishing a desired functional angle 68 between the first and second sections 54 and 56. In like manner, section 58 is unfolded to establish a like functional angle between sections 56 and 58. In a preferred embodiment of the invention, for reasons which will be hereinafter explained, angle 68 is preferably 135 degrees. Thus, in the embodiment of FIG. 3A, the sections fold one way from an imaginary plane through the center section 56 towards a shipping position, and in the opposite direction from the imaginary plane to the functional position. The position of the bend lines or axes 60 and 62 enable a single piece of decorative flexible skin, such as a fabric, to extend uninterruptedly from one end 38 of module 32 to the other end 40, along the second side 36. Thus, joints 50 and 52 are not visible when viewing module 32 from the second side, making it appear that the sections are permanently bent at the selected functional angle. Joints 50 and 52 appear simply as vertical lines when viewing module 32 from the first side 34, as the joints are completely closed when the sections are folded from their shipping positions to their functional positions.

Figure 3B:
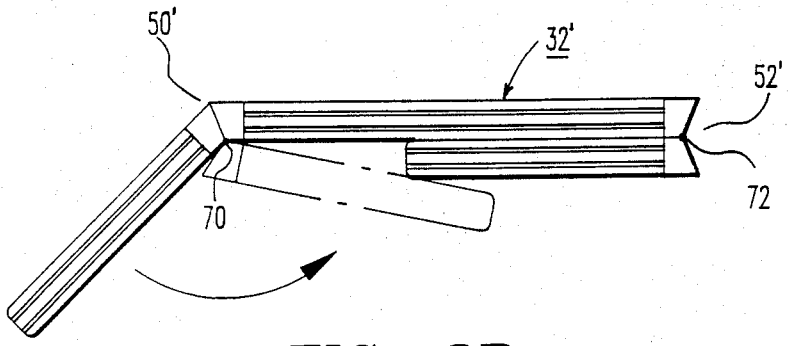
FIG. 3B is a plan view similar to that of FIG. 3A, except showing folding of the sections according to another embodiment of the invention.

FIG. 3B illustrates a module 32' which is similar to module 32 except joints 50 and 52 are modified and referred to as joints 50' and 52'. In the embodiment of FIG. 3B, joints 50' and 52' are foldable about bend lines or axes 70 and 72 through a more limited range of movement, such as about 45 degrees when the functional angle is 45 degrees. Axes 70 and 72 are disposed closely adjacent to the first side 34 of module 32. Thus, the first sides 34 of the sections face one another in both the shipping and functional configurations, and instead of a single piece of flexible skin extending from end to end along the second side 36, it may be attached to the first side 34. Thus, no joint will be discernible between the sections of the module from the first side, while only vertical lines are visible when facing the module from the second side 36.

Figure 3C:
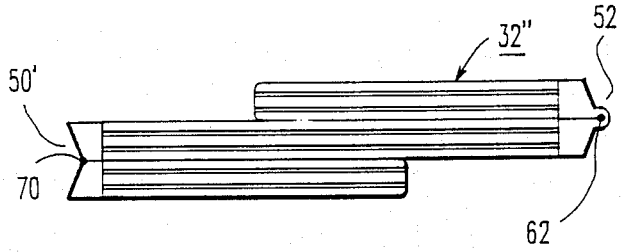
FIG. 3C is a plan view similar to that of FIGS. 3A and 3B, illustrating that joint configurations of FIGS. 3A and 3B may be mixed in a single module.

FIG. 3C is a plan view of a module 32", illustrating that a short flat shipping configuration may be achieved, when the outside sections would overlap if folded on the same side of the center section, by utilizing joint 52 from the FIG. 3A embodiment, and joint 50' from the FIG. 3B embodiment.

Figure 4:
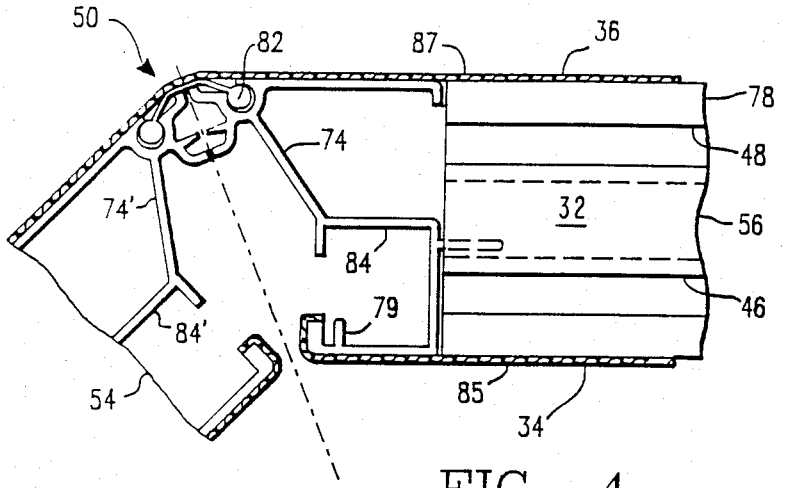
FIG. 4 is a plan view of a joint between two sections of a module, taken between arrows IV—IV in FIG. 2.
Figure 5:
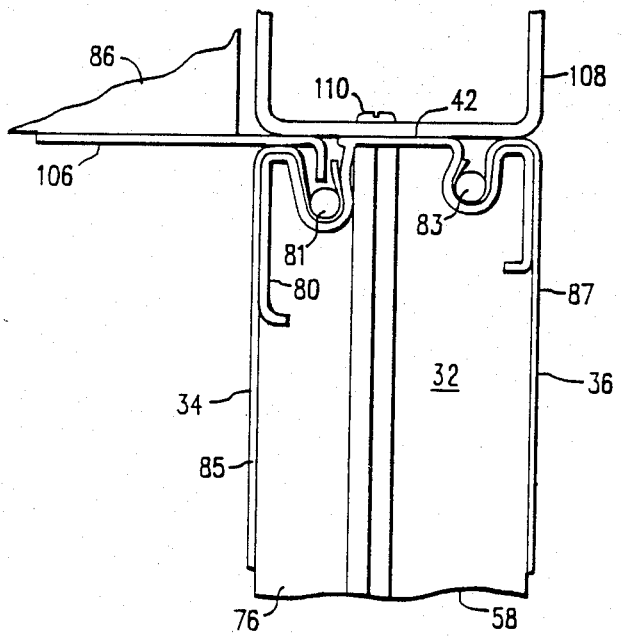
FIG. 5 is an elevational view illustrating a joint between a base module, a wire manager, and a work surface, taken between arrows V—V in FIG. 2.

Each section of module 32 may be of similar construction, having first and second sides or vertically oriented extrusions, such as side rail extrusions 74 and 76 shown in FIGS. 4 and 5, respectively, and top and bottom extrusions, such as top extrusions 78 and 80 shown in FIGS. 4 and 5, respectively. In other words, four extrusions, such as aluminum extrusions, are suitably connected end to end to form a strong metallic frame. FIG. 4 is a plan view of joint 50 taken between arrows IV—IV in FIG. 2. Side rail 74 of section 56, and a similar side rail 74' of section 54 have small pockets adjacent side 36 for receiving a resilient elastomeric hinge 82. A flexible skin 87, as hereinbefore explained, extends from end 38 to end 40 in the embodiment of FIG. 3A, covering hinge 82. In the FIG. 3B embodiment, the hinge receiving pockets would be formed in the side rail extrusions adjacent to side 34. The side extrusions 74 and 74' have additional pockets 84 and 84', respectively, with the bottom openings to these pockets receiving levelers 49, and with the top openings to certain of these pockets in selected modules receiving alignment and locking pins, as will be hereinafter explained. A lip 79 may be provided in pocket 84, for example, which is suitably notched for cooperation with a locking pin or module interlock.

FIG. 5 is an elevational end view of section 58 of module 32, illustrating pockets in the top extrusion 80 for receiving beadings 81 and 83 which help secure flexible outer skins 85 and 87 to sides 34 and 36, respectively.

Returning to FIG. 2, a work surface 86 is supported by the upper edge 42 of the base module 32. Work surface 86 has upper and lower surfaces 88 and 90, a back edge 92, first and second lateral edges 94 and 96 which extend outwardly from the back edge 92 at the same angle as angle 68 shown in FIG. 3A, and a front edge 100. The front edge may extend in a straight line between the ends of the lateral edges 94 and 96, along broken line 98, to form a trapezoidal configuration; or, as illustrated in FIG. 2, the front edge may be constructed of first, second and third edges 99, 100 and 102. Edges 99 and 102 extend perpendicularly outward from edges 94 and 96, respectively, for predetermined like dimensions, and edge 100 extends between the terminations of edges 99 and 102. The configuration of work surface 86 shown in FIGS. 1 and 2 provides desirable additional work surface, while cooperating with similarly configured work surfaces of adjacent units, to effectively form small work surfaces between adjacent units when a plurality of units are assembled to form a complex work station, as will be hereinafter described.

L-shaped brackets, such as brackets 104 and 106, have one leg fastened to the bottom surface 90 of work surface 86, and the remaining leg enters one of the grooves in the upper edge 42 of module 32, such as groove 46. Work surface 86, when so placed, rigidizes module 32, holding sections 54, 56 and 58 in the desired angular relationship.

Different work surface heights may be easily achieved by utilizing brackets which have an upward, or a downward, "step" or right angle bend therein at the point where the bracket leaves the upper edge of a module and crosses an imaginary extension of a side surface of a section. The bracket would then proceed upwardly, or downwardly, closely adjacent to the side surface of the section until reaching the desired dimension, at which point another right angle bend restores the bracket of a horizontal orientation for attachment to the work surface.

A wire manager 108 is disposed upon the upper edge 42 of base module 32, after work surface 86 is positioned on edge 42. As shown in FIG. 5, which is an end elevational view of section 58 of base module 32, the upper extrusion 80 is constructed such that the upper surface of bracket 106 is on the same horizontal level as the remaining exposed surface of extrusion 80. Thus, wire manager 108 is supported both by the work surface supporting brackets, such as brackets 104 and 106, and by the upper extrusion 80 of each section 54, 56 and 58. Wire manager 108 is suitably fixed on the upper edge 42 of base module 32, such as by a plurality of screws 110.

Wire manager 108 is compartmentalized for separating power and communication cables, and it may be similar to the raceway shown in U.S. Pat. No. 4,593,505, which is assigned to the same assignee as the present application. Wire manager 108 further includes openings 112 and 114 for gaining access to electrical terminal blocks located in the electrical power compartment, such as terminal blocks shown in U.S. Pat. No. 4,634,212, which is also assigned to the same assignee as the present application. Work surface 86 includes troughs 116 and 118 in edges 94 and 96, respectively, for gaining access to openings 112 and 114. Troughs 116 and 118 have removable covers, such as cover 120, for covering them when the terminal blocks are are not being accessed. Flexible lips on the covers, such as flexible lip 122, enable wires to enter the troughs from the work surface 86 with the covers 120 in place. End caps cover the ends of wire manager 108, such as end cap 123. End caps of adjacent units in a work station may be removed and replaced with a suitable interconnection to run wires between adjacent units.

The base module 32 is approximately 26 inches (66 cm) high, the wire manager is approximately 5 inches (13 cm) high, and the levelers 49 add approximately 1 inch (2.54 cm), to provide a height of approximately 32 inches (81 cm) to the top of the wire manager. The desired number of additional modules are stacked vertically one upon the next to provide the desired height of the unit 30, with the additional modules being of similar construction to the base module 32, except having a smaller height dimension, such as a height of about 16 inches (40 cm). For purposes of example, three additional modules 124, 125 and 126 are shown in FIG. 2. End caps, such as end cap 128, and a top cap 130 complete unit 30.

Figure 8:
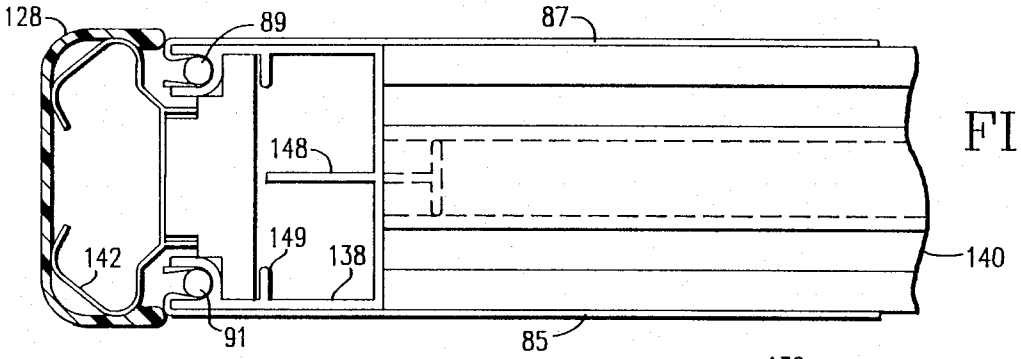
FIG. 8 is a plan view of the outer corner shown in FIG. 6, without a top cap.
Figure 6:
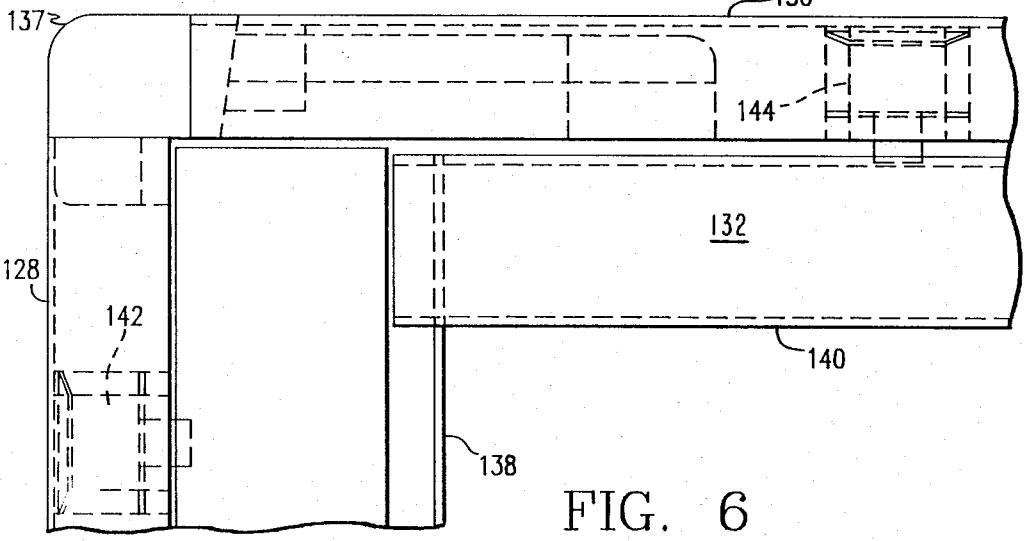
FIG. 6 is an elevational view of an outer corner of an uppermost module, taken between arrows VI—VI in FIG. 2.
Figure 7:
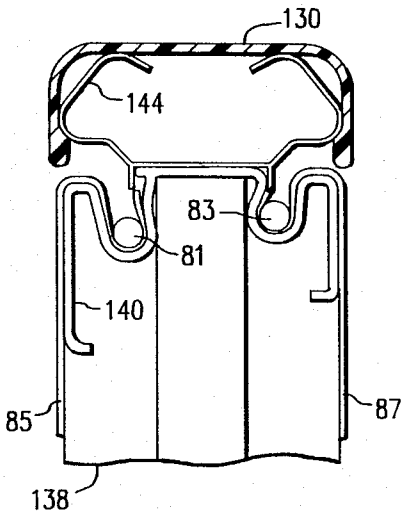
FIG. 7 is an elevational end view of the outer corner shown in FIG. 6, without an end cap.

The uppermost module 126 includes first, second and third sections 132, 134 and 136, respectively, with FIG. 6 being an elevational view of the upper left hand corner 137 of the first section 132 shown without a flexible outer skin to show side and top extrusions 138 and 140. FIG. 7 is an end elevational view of corner 137, and FIG. 8 is a plan view of corner 137. As illustrated a plurality of springs, such as spring 142, may be fixed to the side extrusions of the modules for attaching end cap 128. In like manner, a plurality of springs, such as spring 144, may be attached to the top extrusion 140 for securing top cap 130. Beading 89 and 91 shown in FIG. 8 attaches flexible outer skins 87 and 85, respectively, along the sides of a module.

It is important that the vertically stacked modules of unit 30 be aligned and releasably locked together, permitting module 30 to be picked up and moved as a whole when necessary. FIG. 2 illustrates alignment and locking devices or interlocks 146 for this purpose, and FIGS. 9 through 13 illustrate an exemplary embodiment of a suitable interlock 146. Interlock 146 is constructed of a suitable plastic, such as a polycarbonate.

Figure 11:
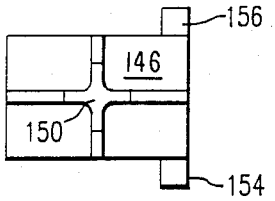
FIG. 11 is a plan view of the interlock shown in FIG. 9.
Figure 9:
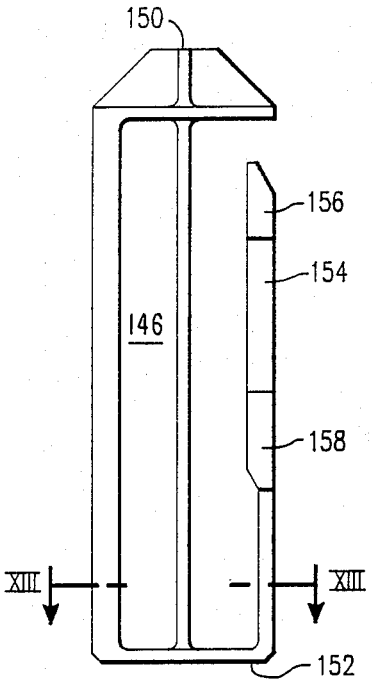
FIG. 9 is an elevational view of an interlock suitable for engaging, aligning and releasably locking the vertically stacked modules of a unit via pockets in extrusions which form side rails of the modules.
Figure 10:
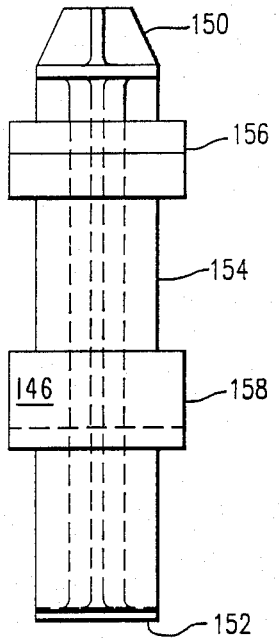
FIG. 10 is an end elevational view of the interlock shown in FIG. 9.
Figure 13:
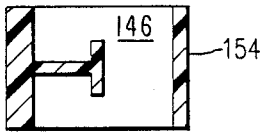
FIG. 13 is a cross sectional view of the interlock shown in FIG. 9, taken between and in the direction of arrows XIII—XIII.
Figure 12:
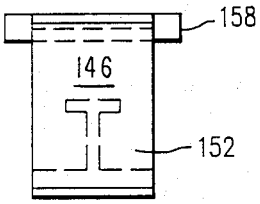
FIG. 12 is a bottom view of the interlock shown in FIG. 9.

FIG. 9 is an elevational side view of interlock 146, FIG. 10 is in elevational end view, FIG. 11 a top or plan view, FIG. 12 a bottom view, and FIG. 13 a cross sectional view taken in the direction of arrows XIII—XIII in FIG. 9. As hereinbefore stated, extrusion 74 shown in FIG. 4 has an extrusion pocket 84 for receiving an interlock 146, and extrusion 138 shown in FIG. 8 has a similarly dimensioned extrusion pocket 148, including a lip 149, for receiving interlock 146. The extrusion pockets define closely adjacent, coaxial upper and lower openings in upper and lower vertically adjacent sections of vertically adjacent modules to be releasably joined together.

Interlock 146 has upper and lower ends 150 and 152, respectively, with a flexible upstanding finger 154 rising from the lower end 152. Finger 154 has upper and lower, vertically spaced rectangular portions 156 and 158, respectively. The lower end 152 is advanced downwardly into an extrusion pocket in the lower of two parts to be joined, and finger 154 is flexed inwardly by one of the inwardly projecting lips 79 or 149 until the lower rectangular portion 158 reaches a suitably dimensioned relief or notch formed in the lip, allowing the finger to move outwardly when the inward bias is released, to secure rectangular portion 158 and interlock 146 in the lower of the two pieces. Lowering an upper module upon a lower module, or wire manager, as the case may be, performs a similar function, with the upper end 150 entering the extrusion pocket and the upper rectangular portion 156 locking the interlock to the upper module. Suitable small openings in the extrusion allow a tool to be inserted which may be pressed against finger 154 to release the interlock 146 when an upper module is to be removed from a lower element of unit 30.

Figure 14:
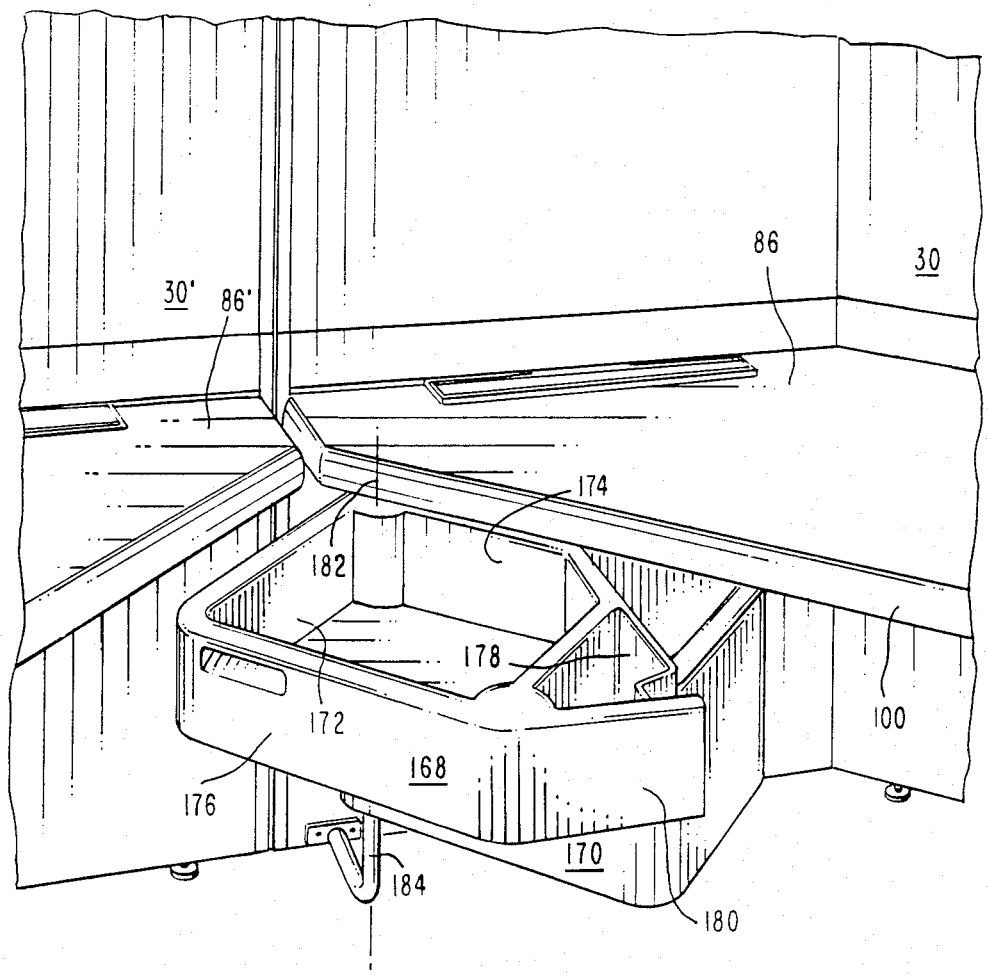
FIG. 14 is a perspective view of the pivotable five-sided drawer shown in FIG. 1, with the uppermost drawer shown in an open position.

Returning to FIG. 1, unit 30 may be provided with accessories, such as cabinets 160 and 162 supported by the upper edges of modules 125 and 126, respectively, task lights 164 and 166 mounted on the lower surface of cabinet 160, and one or more drawers, with two drawers 168 and 170 being shown for purposes of example. Drawers 168 and 170 are preferably constructed according to another aspect of the invention, with FIG. 14 being a fragmentary perspective view of unit 30 illustrating drawer 168 in an open position. Unit 30 is disposed end to to end with another unit, referenced 30', illustrating adjacent work surfaces 86 and 86'.

More specifically, drawers 168 and 170 are mounted below one of the narrow "wings" of work surface 86 formed by edge 94 and front 100, and they have a five sided configuration in plan view to uniquely and snugly fit the space. Referring to the closed position of top drawer 168, the five sides include a front 172 which is parallel with the front edge 100 of work surface 86, an inner side 174 which proceeds perpendicularly inward from front edge 100 until it is closely adjacent to section 54 of base module 32, an outer side 176 which is opposite to and parallel with inner side 174, a side 178 which is closely adjacent to the angled section 54 of the base module, and a side 180 which converges smoothly inward from side 176 to intersect side 178 at section 54.

Drawers 168 and 170 pivot between open and closed positions about a vertically oriented pivot axis 182 which is located at the intersection of front 172 and drawer inner side 174. The pivot axis 182 is provided by a shaft 184 which extends perpendicularly downward from the work surface 86. Shaft 184 has a right angle bend below the lowest drawer 170, and is firmly anchored to section 54 of base module 32.

Figure 15:
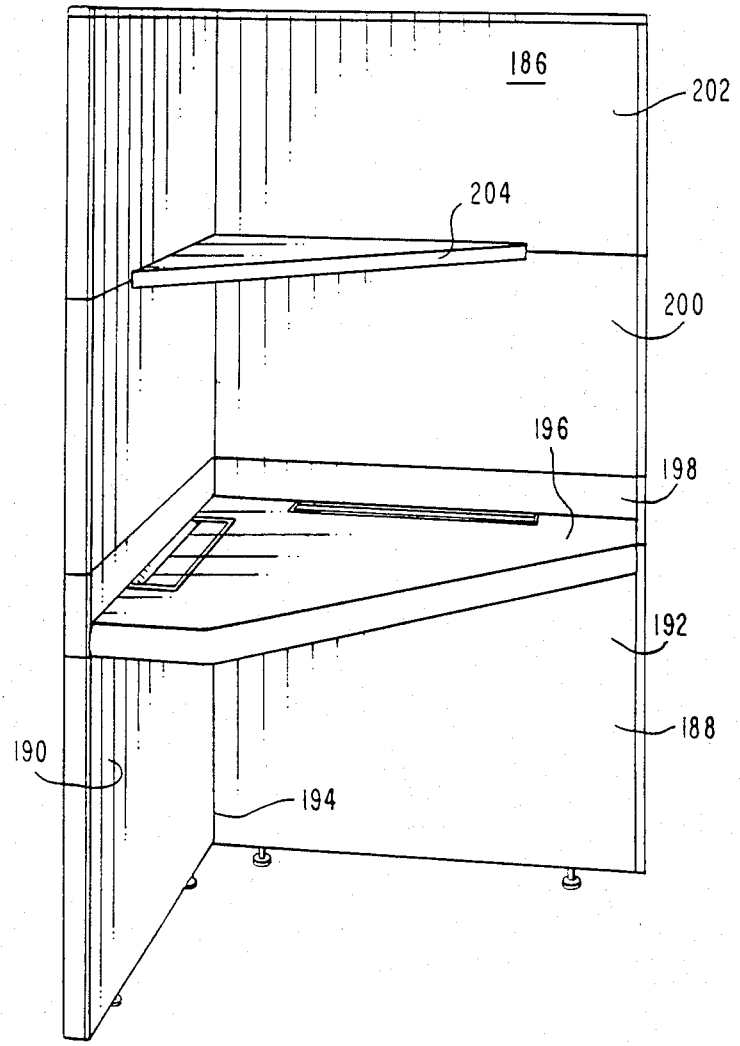
FIG. 15 is a perspective view of a second basic stand-alone unit constructed according to the concepts of the invention.

FIG. 15 is a perspective view of a second basic stand-alone unit 186 constructed according to the teachings of the invention. Unit 186 is similar in construction to unit 30, except each module has two sections instead of three.

More specifically, unit 186 includes a base module 188 having first and second integrally joined sections 190 and 192 separated by a joint 194 which enables sections 190 and 192 to be folded between shipping and functional configurations, in the same manner as the modules of unit 30. The functional configuration provides a predetermined angle between sections 190 and 192, such as 90 degrees. A work surface 196 is supported by base module 188, and a wire manager 198 is mounted on the upper edge of base module 188. Additional modules are then vertically stacked upon the base module 188 to achieve the desired height, such as modules 200 and 202. Accessories may be mounted on the modules at any level, such as a shelf 204 which is mounted on the upper edge of module 200.

Figure 16:
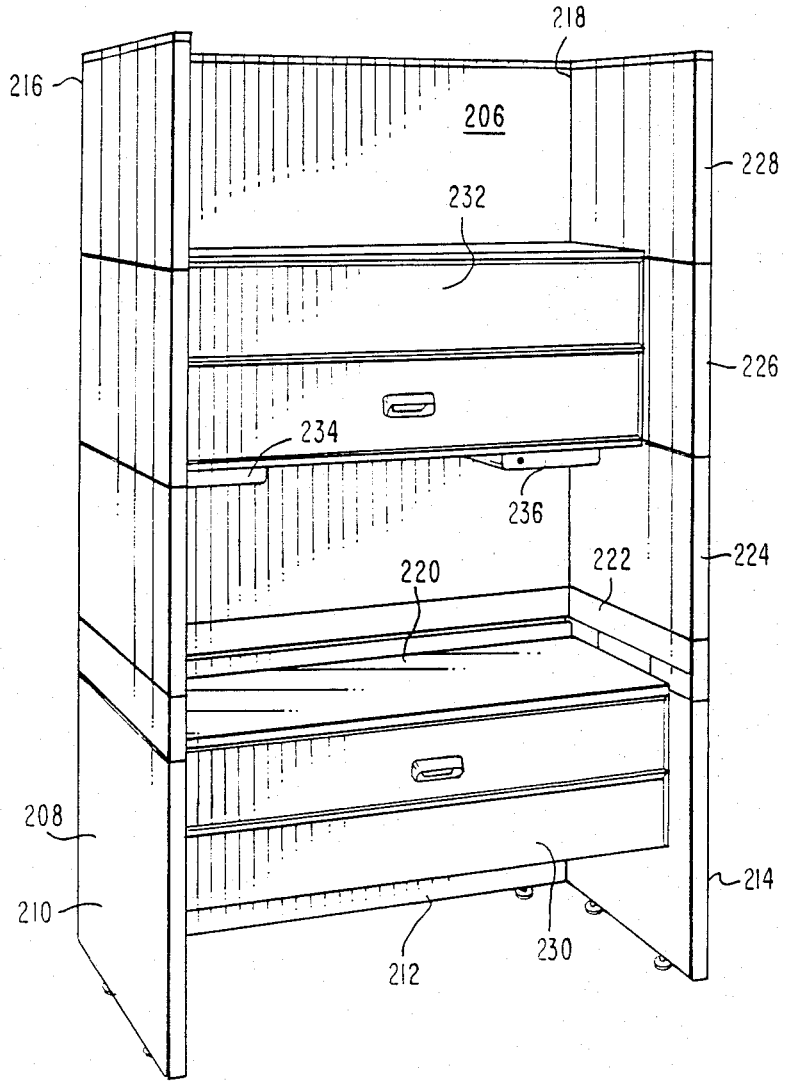
FIG. 16 is a perspective view of a third basic stand-alone unit constructed according to the teachings of the invention.

FIG. 16 is a perspective view of a third basic stand-alone unit 206. Unit 206 is similar to unit 30 in that the vertically stacked modules have three sections, and it is similar to unit 186 as it forms 90 degree angles between the sections of the modules.

More specifically, unit 206 includes a base module 208 having three integrally joined sections 210, 212 and 214 separated by joints 216 and 218. Joint 216 forms a right angle between sections 210 and 212, and joint 218 forms a right angle between sections 212 and 214, in the functional configuration. Joints 216 and 218 are foldable from the functional configuration to a shipping configuration, using either of the arrangements hereinbefore set forth in FIGS. 3A and 3B.

A work surface 220 and wire manager 222 are mounted on the upper edge of base module 208, and a plurality of additional modules are vertically stacked on the base module, such as additional modules 224, 226 and 228. Accessories may be mounted on the modules at any level, with a drawer 230 being shown mounted below work surface 220 and a cabinet 232 being shown mounted on module 226. Task lights 234 and 236 are illustrated mounted below cabinet 232.

In a preferred embodiment of the invention, the three basic units 30, 186 and 206 are configured and dimensioned such that the sections of the modules all lie upon an imaginary grid, or diagonals thereof, with the imaginary grid having squares dimensioned N per side. An N of 2 feet (60 cm) has been found to be very suitable, with all modules having a width dimension which is a function of N. The functions of N include integers of N, e.g., N and 2N, and the square root of $2N^2$.

FIGS. 17 and 18 illustrate the crossing points of an imaginary grid, with first and second "footprints" of the first basic stand-alone unit 30 disposed thereon. Using the sections of the base module 32, the first and third sections 54 and 58 both form diagonals of the grid, and thus they each have a width dimension equal to the square root of $2N^2$. The back section 56 lies upon a row line of the imaginary grid and is a integer of N. FIG. 17 illustrates unit 30 in which the integer is 2, making the width of section 56 equal to 2N, and FIG. 18 illustrates unit 30' in which the integer is 1, making the width of section 56' equal to N. Line 160 indicates the front of cabinet 160, line 100 indicates front of work surface 86, and line 98 indicates the front of an alternative configuration of work surface 86, as hereinbefore described relative to FIG. 2. Using the grid concept and making all dimensions lie upon the grid, or diagonals thereof, and further making all dimensions which lie upon the grid an integer of N, the basic dimension of the grid, provides for ease in dimensioning, as well as efficient utilization of the available floor space. It can easily be determined, for example, that the dimension across the front of work surface 86 is equal to 4N, and the dimension across the front of work surface 86' is 3N, simply by referring to a layout of a work station prepared upon grid paper.

FIG. 19 illustrates unit 186 on an imaginary grid, similar to the grid shown in FIGS. 17 and 18. Sections 190 and 192 of the base module 188 both form diagonals of the grid and have width dimensions equal to the square root of $2N^2$. Line 238 indicates the front edge of work surface 196, and line 240 indicates the alternative front edge, both of which have a dimension of about 2N. Line 204 indicates the front edge of shelf 204.

FIG. 20 illustrates unit 206 on an imaginary grid, with sections 210, 212 and 214 all being on the grid lines. The side sections 210 and 214 each have a dimension of N, and the back section 212 has a dimension equal to 2N. Line 232 indicates the front of cabinet 232, and lines 242 and 244 indicate the alternative front edges of work surface 220.

Figure 21:
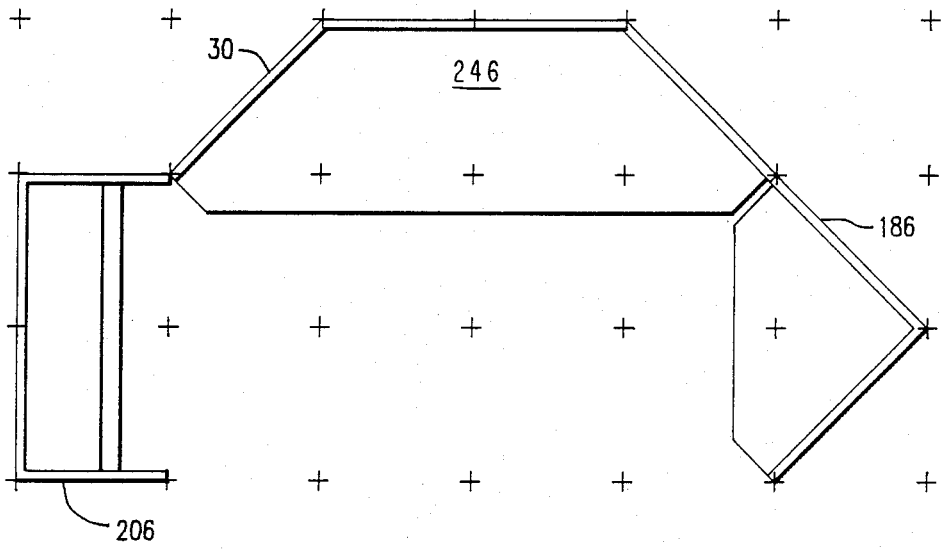
FIG. 21 is an exemplary work station configuration, using the three basic unit configurations.
Figure 22:
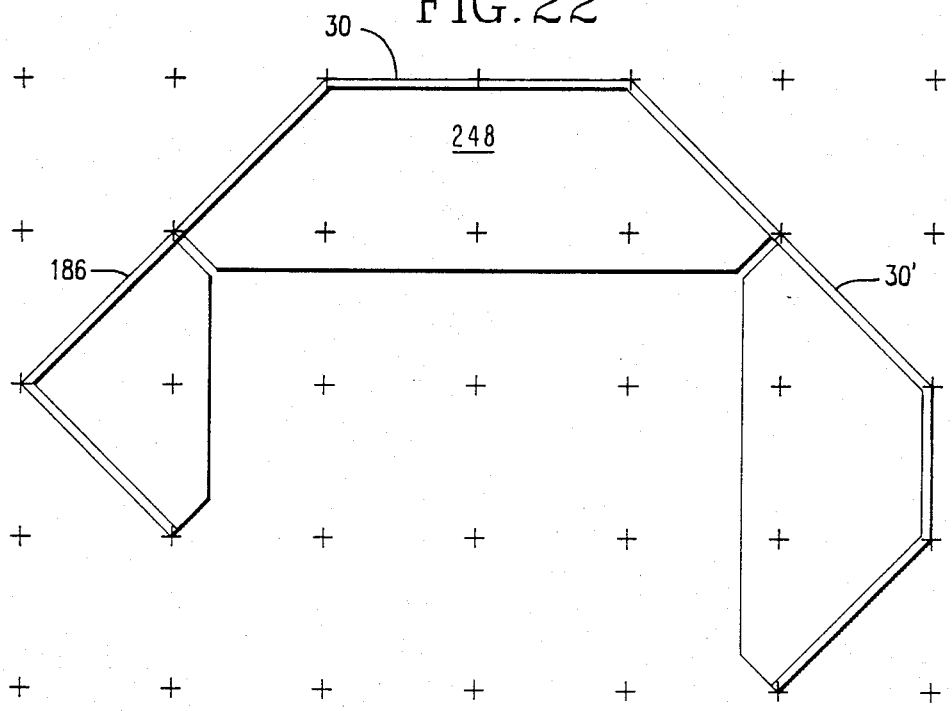
FIG. 22 is another exemplary work station configuration, using two variations of the first basic unit configuration and the second basic configuration.

FIGS. 21 and 22 indicate the ease in laying out complex work station configurations on grid paper, using the basic stand-alone units. FIG. 21 indicates formation of a work station 246 using units 30, 186 and 206, and FIG. 22 indicates formation of a work station 248 using units 30, 30' and 186. Many other combinations of the units may be used, of course, to configure a work station to any need.

An important aspect of the invention is the fact that the units are stand-alone, and do not share their walls with any other work station. One work station may form a wall of an adjacent work station, but they are not shared from the standpoint of both work stations hanging accessories from a common wall. FIG. 23 indicates an office floor plan layout 249 setting forth one of many multiple work station configurations that may be used to effectively utilize an available office space. For purposes of example, layout 249 has eight work stations 250, 252, 254, 256, 258, 260, 262 and 264. Each work station, such as work station 250, is constructed of units 30', 30 and 206. While back sides of units 30, and 30' from work station 252 form a wall 266 of work station 250, it is a privacy wall and otherwise non-functional in work station 250, e.g., wall 266 does not support accessories in work station 250. The units of work station 250 may each be individually moved as a whole, without disturbing adjacent work stations 252 and 258, and they may be moved without disturbing the user's belongings in the units, if desired.

We claim:

1. An office space dividing arrangement, comprising:

at least one work station, said at least one work station including a first module having first and second sides, first and second ends, and upper and lower edges which extend between said ends, said first module having at least one joint, said at least one joint defining a bend line which extends between said upper and lower edges to define at least first and second integrally joined sections, said first module being in a functional configuration in which said at least first and second sections intersect at a first predetermined angle to define a free-standing base portion of said at least one work station, said first module being foldable along said bend line to a shipping configuration which minifies shipping space, a work surface supported by the upper edge of the first module, with the first side facing the work surface, and a flexible skin on the second side which extends uninterruptedly between the first and second ends.

2. The office space dividing arrangement of claim 1 wherein the at least one work station includes a second module having first and second sides, first and second ends, and upper and lower edges which extend between said ends, said second module having at least one joint, said at least one joint defining a bend line which extends between said upper and lower edges to define at least first and second integrally joined sections, said second module being in a functional configuration in which said at least first and second sections intersect at the same predetermined angle as the first predetermined angle, said second module being supported by the upper edge of the first module to increase the height of the work station.

3. The office space dividing arrangement of claim 1 wherein the first module includes an electrical wire manager which extends along and is supported by the upper edge of the first module.

4. The office space dividing arrangement of claim 1 wherein the first sides of the first and second sections define inner sides of the work station, and wherein the second sides of the first and second sections face one another when the first module is folded along the bend line.

5. The office space dividing arrangement of claim 1 wherein the first sides of the first and second sections define inner sides of the work station, and wherein the first sides of the first and second sections also face one another when the first module is folded along the bend line.

6. The office space dividing arrangement of claim 1 wherein the at least first and second integrally joined sections define an angle of 90 degrees between in the functional configuration.

7. An office space dividing arrangement, comprising:

at least one work station, said at least one work station including a first module having first and second sides, first and second ends, and upper and lower edges which extend between said ends, said first module having at least one joint, said at least one joint defining a bend line which extends between said upper and lower edges to define at least first and second integrally joined sections, said first module being in a functional configuration in which said at least first and second sections intersect at a first predetermined angle to define a free-standing base portion of said at least one work station, said first module being foldable along said bend line to a shipping configuration which minifies shipping space, a wire manager and a work surface supported by the upper edge of the first module, and including at least one trough in the work surface for gaining access to the wire manager.

8. An office space dividing arrangement, comprising:

at least one work station, said at least one work station including a first module having first and second sides, first and second ends, and upper and lower edges which extend between said ends, said first module having first and second joints, said first and second joints defining first and second bend lines, respectively, which extend between said upper and lower edges to define first, second and third integrally joined sections, said first module being in a functional configuration in which the first and second joints orient the first, second, and third sections to define a free-standing base portion of said at least one work station, said first module being foldable along said first and second bend lines to a shipping configuration to minify shipping space, a work surface supported by the upper edge of the first module, with the first side facing the work surface, a flexible skin on the second side which extends uninterruptedly between the first and second ends.

9. The office space dividing arrangement of claim 8 wherein the at least one work station includes a second module having first and second sides, first and second ends, and upper and lower edges which extend between said ends, said second module having first and second joints, said first and second joints defining first and second bend lines, respectively, which extend between said upper and lower edges to define first, second and third integrally joined sections, said second module being in a functional configuration in which the first and second joints orient the first, second, and third sections to define a free-standing extension module of the at least one work station said second module being supported by the upper edge of the first module to increase the height of the work station.

10. The office space dividing arrangement of claim 8 wherein the first module includes an electrical wire manager which extends along and is supported by the upper edge of the first module.

11. The office space dividing arrangement of claim 8 wherein the first sides of the first, second and third sections define inner sides of the work station, and wherein the second sides of the first, second and third sections face one another when the first module is folded along the first and second bend lines.

12. The office space dividing arrangement of claim 8 wherein the first sides of the first, second and third sections define inner sides of the work station, and wherein the first sides of the first, second and third sections also face one another when the first module is folded along the first and second bend lines.

13. The office space dividing arrangement of claim 8 wherein the functional configuration orients each of the first and third sections at an angle of about 135 degrees relative to the second section, and wherein said work surface includes a work surface having a front, a back, and first and second diagonal sides which define a substantially trapezoidal configuration, said work surface being supported by the upper edge of the module.

14. The office space dividing arrangement of claim 13 including at least one drawer below the work surface which is pivoted about a substantially vertical pivot axis, substantially at the intersection of the front and one of the first and second diagonal sides of the work surface.

15. The office space dividing arrangement of claim 14 wherein the at least one drawer has five vertically oriented sides.

16. The office space dividing arrangement of claim wherein said work surface includes a work surface having a front, a back and first and second diagonal sides, with the front of the work surface including first and second ends, and first and second diagonal corners at the first and second ends, respectively, which intersect the first and second diagonal sides.

17. The office space dividing arrangement of claim 8 wherein the first and third sections each define an angle of about 135 degrees with the second section in the functional configuration.

18. The office space dividing arrangement of claim 17 wherein the second section has a width equal to a predetermined dimension N and each of the first and third sections have a width equal to the square root of $2N^2$.

19. The office space dividing arrangement of claim 8 wherein the first and third sections each define an angle of about 90 degrees with the second section in the functional configuration.

20. The office space dividing arrangement of claim 19 wherein the first, second and third sections each have a width dimension equal to a predetermined dimension N multiplied by a predetermined whole number.

21. An office space dividing arrangement, comprising:

at least one work station, said at least one work station including a first module having first and second sides, first and second ends, and upper and lower edges which extend between said ends, said first module having first and second joints, said first and second joints defining first and second bend lines, respectively, which extend between said upper and lower edges to define first, second and third integrally joined sections, said first module being in a functional configuration in which the first and second joints orient the first, second, and third sections to define a free-standing base portion of said at least one work station, said first module being foldable along said first and second bend lines to a shipping configuration to minify shipping space, a wire manager and a work surface supported by the upper edge of the first module, and including at least one trough in the work surface for gaining access to the wire manager.

22. An office space dividing arrangement, comprising:

at least one work station, said at least one work station including a plurality of discrete, vertically stacked modules, at least certain of said vertically stacked modules having at least two side-by-side integrally joined sections disposed at a predetermined angle relative to one another, said at least two integrally joined sections being foldable to a shipping configuration along a bend line which separates said at least two integrally joined sections, vertically adjacent sections of at least two vertically adjacent modules including vertically oriented side rails which define closely adjacent, coaxial upper and lower openings, respectively, and a releasable interlock having upper and lower ends disposed in said upper and lower openings, with said interlock releasably engaging both of the vertically adjacent sections, said interlock including a flexible finger having upper and lower spaced portions which are biased into locking engagement with cooperative portions of the vertically adjacent sections associated with the interlock.

23. An office space dividing arrangement, comprising:

at least one work station, said at least one work station including a plurality of discrete, vertically stacked modules, at least certain of said vertically stacked modules having at least three side-by-side integrally joined flat sections disposed at predetermined angles relative to one another, said at least three integrally joined flat sections being foldable to a shipping configuration along bend lines which separate said at least three integrally joined sections, vertically adjacent sections of at least two vertically adjacent modules including vertically oriented side rails which define closely adjacent, coaxial upper and lower openings, respectively, and a releasable interlock having upper and lower ends disposed in said upper and lower openings, with said interlock releasably engaging both of the vertically adjacent sections, said interlock including a flexible finger having upper and lower spaced portions which are biased into locking engagement with cooperative portions of the vertically adjacent sections associated with the interlock.

24. An office space dividing arrangement, comprising:

a plurality of discrete, free-standing adjacent work stations, each having at least first and second upstanding wall portions, said at least first and second upstanding wall portions having inner sides which face the associated work station, and outer sides, said at least first and second upstanding wall portions including a plurality of discrete, vertically stacked modules each having a section in each of said first and second wall portions, said sections of each module being integrally joined to one another along foldable joints which define vertically oriented bend lines, said discrete work stations each being dimensioned such that the at least first and second wall portions have width dimensions which are predetermined functions of a predetermined dimension N, vertically adjacent sections of at least two vertically adjacent modules include vertically oriented side rails which define closely adjacent, coaxial upper and lower openings, respectively, and a releasable interlock having upper and lower ends disposed in said upper and lower openings, with said interlock releasably engaging both of the vertically adjacent sections, said interlock including a flexible finger having upper and lower spaced portions which are biased into locking engagement with cooperative portions of the vertically adjacent sections associated with the interlock.

25. The office space dividing arrangement of claim 24 wherein outer sides of at least two of the plurality of adjacent work stations are disposed in closely spaced adjacent relation.

26. The office space dividing arrangement of claim 24 wherein the at least first and second wall portions of the plurality of work stations define first and second ends of the associated work station, and wherein one of the first and second ends of at least one of the work stations is disposed in closely spaced relation with one of the first and second ends of another of the work stations.

27. The office space dividing arrangement of claim 24 wherein the predetermined dimension N is two feet.

28. The office space dividing arrangement of claim 24 wherein the predetermined functions of N include a predetermined whole number multiplied by the predetermined dimension N, and the square root of $2N^2$.

29. An office space dividing arrangement, comprising:

a plurality of discrete, free-standing adjacent work stations, at least certain of said work stations having at least first, second and third upstanding wall portions, said first, second and third upstanding wall portions having inner sides which face the associated work station, and outer sides, said first, second and third upstanding wall portions including a plurality of discrete, vertically stacked modules each having a section in each of said first, second and third wall portions, said sections of each module being integrally joined to one another along foldable joints which define vertically oriented bend lines, said discrete work stations each being dimensioned such that said first, second and third upstanding wall portions have width dimensions which are predetermined functions of a predetermined dimension N, vertically adjacent sections of at least two vertically adjacent modules including vertically oriented side rails which define closely adjacent, coaxial upper and lower openings, respectively, and a releasable interlock having upper and lower ends disposed in said upper and lower openings, with said interlock releasably engaging both of the vertically adjacent sections, said interlock including a flexible finger having upper and lower spaced portions which are biased into locking engagement with cooperative portions of the vertically adjacent sections associated with the interlock.

30. The office space dividing arrangement of claim 29 wherein outer sides of at least two of the plurality of adjacent work stations are disposed in closely spaced adjacent relation.

31. The office space dividing arrangement of claim 29 wherein the at least first and second wall portions of the plurality of work stations respectively define first and second ends of the associated work station, and wherein one of the first and second ends of at least one of the work stations is disposed in closely spaced relation with one of the first and second ends of another of the work stations.

32. The office space dividing arrangement of claim 29 wherein the predetermined dimension N is two feet.

33. The office space dividing arrangement of claim 29 wherein the predetermined functions of N include the predetermined dimension multiplied by the predetermined whole no. N; and the square root of $2N^2$.

* * * * *